US006382534B2

(12) United States Patent
Keim

(10) Patent No.: US 6,382,534 B2
(45) Date of Patent: May 7, 2002

(54) FUEL INJECTION VALVE

(75) Inventor: Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/776,325

(22) Filed: Feb. 2, 2001

(30) Foreign Application Priority Data

Feb. 4, 2000 (DE) ..... 100 04 971

(51) Int. Cl.[7] ..... B05B 1/30; F02M 51/00

(52) U.S. Cl. ..... 239/585.5; 239/585.1; 239/585.4; 251/129.21

(58) Field of Search ..... 239/584, 585.1, 239/585.4, 585.5; 251/129.16, 129.21

(56) References Cited

U.S. PATENT DOCUMENTS 5,284,302 A * 2/1994 Kato et al. ..... 239/585.1
6,113,014 A * 9/2000 Coldren et al. ..... 239/585.1
6,220,528 B1 * 4/2001 Cooke et al. ..... 239/585.5

FOREIGN PATENT DOCUMENTS

DE 196 26 576 1/1998

* cited by examiner

*Primary Examiner*—Steven J. Ganey
(74) *Attorney, Agent, or Firm*—Kenyon & Kenyon

(57) ABSTRACT

A fuel injection valve, in particular for fuel injection systems of internal combustion engines, includes a magnet coil, an armature acted upon in a closing direction by a return spring, and a valve needle, in nonpositive engagement with the armature, for actuation of a valve closure element that, together with a valve seating surface, forms a sealing fit. At least one fuel conduit through which fuel flows is provided in the armature and/or in the valve needle. An impact element is mounted on the valve needle in the spray-discharge direction of the fuel conduit.

8 Claims, 1 Drawing Sheet

FUEL INJECTION VALVE

BACKGROUND INFORMATION

German Patent No. DE 196 26 576 describes an electromagnetically actuable fuel injection valve in which an armature coacts with an electrically excitable magnet coil for electromagnetic actuation, and the linear stroke of the armature is transferred via a valve needle to a valve closure element. The valve closure element coacts with a valve seating surface to form a sealing fit. Several fuel conduits are provided in the armature. Return of the armature is accomplished with a return spring.

The fuel injection valve described in German Patent No. DE 196 26 576 is disadvantageous especially with regard to relatively long closing times. Delays in the closing of the fuel injection valve are brought about by the adhesion forces acting between armature and internal pole, and because the magnetic field does not decay instantaneously when the excitation current is switched off. This results in metering times and metered volumes for the fuel that are worth improving. The generation of large closing forces by way of a high return spring force has the disadvantage of a high power requirement for excitation of the magnet coil. The output stage of an electrical control device must then be of correspondingly complex design.

SUMMARY OF THE INVENTION

The fuel injection valve according to the present invention has the advantage that the impact element joined to the valve needle converts the hydraulic momentum of the fuel, flowing in the spray-discharge direction through at least one fuel conduit in the armature or in the valve needle, into a more rapid closing motion.

The opening time remains largely unimpaired by the feature according to the present invention, since hydraulic flow is not yet present when the fuel injection valve opens. The faster detachment of the armature from the internal pole due to a momentum transfer from the fuel to the impact element results in shorter closing times for the fuel injection valve and thus in shorter fuel metering times and more precise metered fuel volumes.

It is advantageous to configure the impact element as an impact plate, since this shape is characterized by a low inert mass.

Also advantageous is the easy and economical manufacture of an integrally configured component comprising the valve needle and impact element, which can be manufactured, for example, as a turned part.

DETAILED DESCRIPTION

Figure 1:
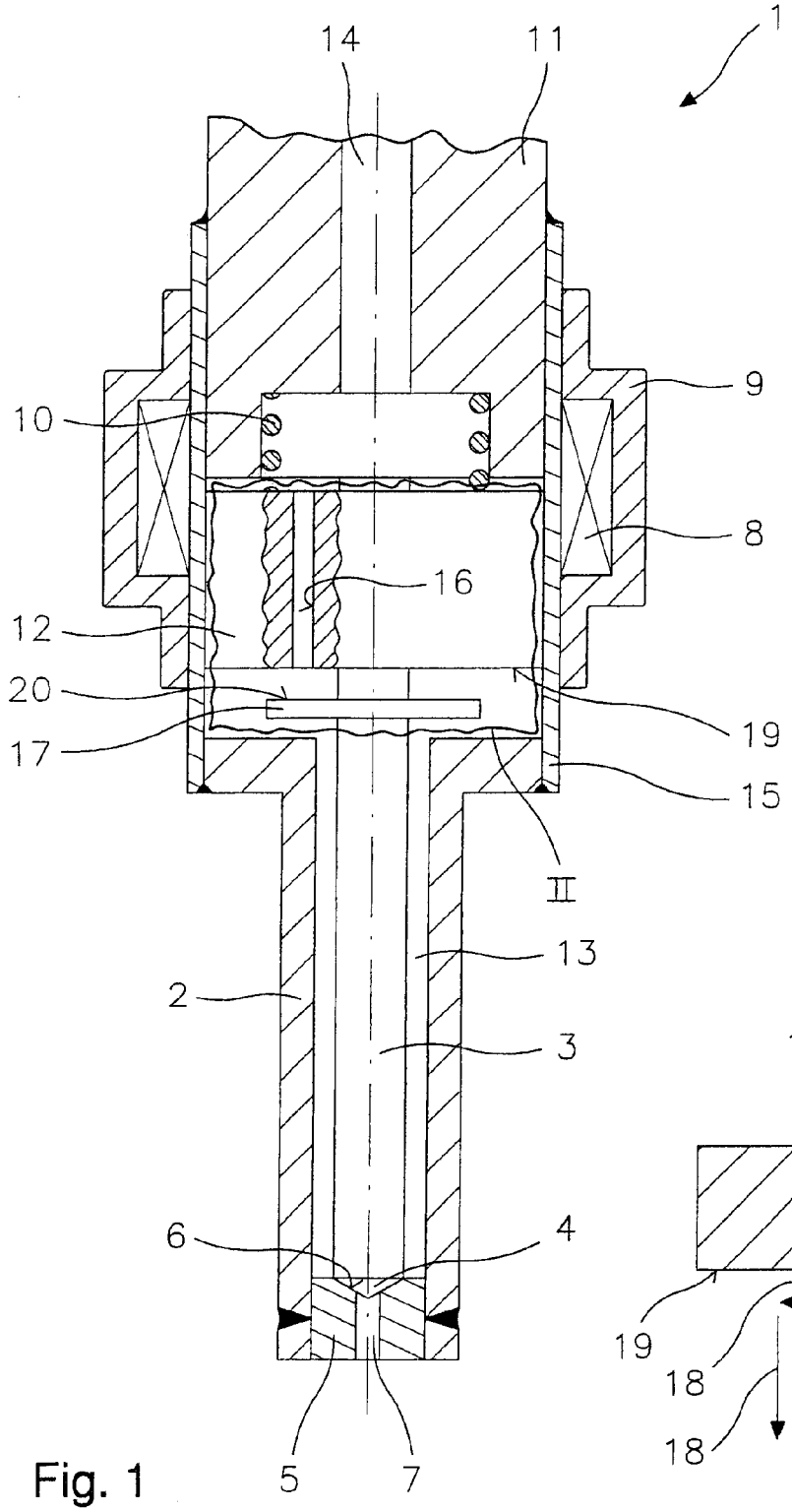
FIG. 1 shows an axial partial section through an exemplary embodiment of a fuel injection valve according to the present invention.

A fuel injection valve 1 depicted in FIG. 1 is, in particular, used for direct injection of fuel into the combustion chamber of a spark-ignited mixture-compressing internal combustion engine. Fuel injection valve 1 comprises a magnet coil 8 surrounded by a magnetic return-flow element 9, a core 11, and a housing element 15 that is welded to a nozzle element 2. An armature 12 that is acted upon by a return spring 10 has at least one fuel conduit 16 (in the form of a bore in the exemplary embodiment) through which the centrally delivered fuel is guided, via an opening 13 between a valve needle 3 and nozzle element 2, to the sealing fit.

Armature 12 is in working engagement with valve needle 3, on which is arranged, downstream from fuel conduit 16, an impact (baffle) element 17. In the exemplary embodiment, impact element 17 is embodied in a disk shape, is configured integrally with valve needle 3 (e.g. as a turned part), and possesses a size such that there is at least a partial overlap of the cross section of fuel conduit 16 with impact element 17 when projected onto a plane. Because of its disk-shaped configuration, impact element 17 has only a small inert mass in relation to its impingement surface 20. Valve needle 3 is configured at the spray-discharge end to form a valve closure element 4. Valve closure element 4 forms a sealing fit with a valve seating surface 6 that is configured on a valve seat element 5. The exemplary embodiment concerns an inward-opening fuel injection valve 1. A spray-discharge opening 7 is configured in valve seat element 5.

When fuel injection valve 1 is in the closed idle state, armature 12 is acted upon by return spring 10 oppositely to its linear stroke direction, in such a way that valve closure element 4 is held in sealing contact against valve seating surface 6. Upon excitation of magnet coil 8, the latter creates a magnetic field which moves armature 12 in the linear stroke direction against the spring force of return spring 10. Armature 12 also entrains valve needle 3, with impact element 17 conformingly mounted thereon, in the linear stroke direction. Valve closure element 4, which in the exemplary embodiment is configured integrally with valve needle 3, lifts off from valve seating surface 6, and the fuel directed via fuel conduit 16 and opening 13 to the sealing fit can enter spray-discharge opening 7.

When the coil current is shut off, armature 12 is released from core 11 by the force of return spring 10 after the magnetic field has sufficiently decayed; as a result, valve needle 3 that is in working engagement with armature 12 moves oppositely to the linear stroke direction, valve closure element 4 is placed onto valve seating surface 6, and fuel injection valve 1 is closed.

Figure 2:
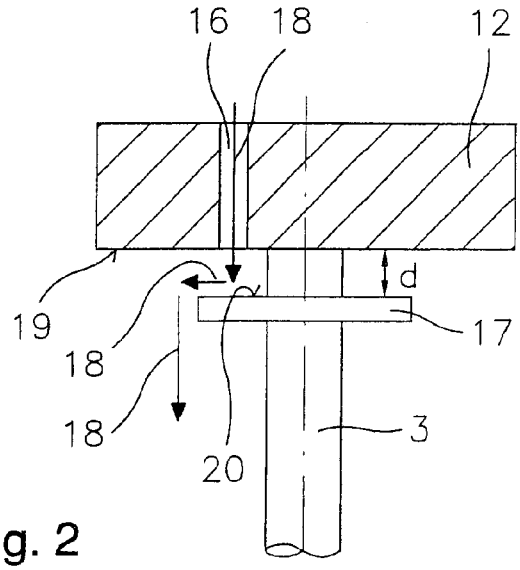
FIG. 2 shows an enlarged portion in region II of FIG. 1.

FIG. 2 shows, in a partial, schematic axial sectioned depiction, fuel injection valve 1 according to the present invention in region II of FIG. 1. The enlarged depiction shows only those components that are of substantial importance with reference to the present invention. Elements already described are labeled with identical reference characters, eliminating any need to repeat descriptions.

The opening operation of fuel injection valve 1 remains largely uninfluenced by the presence of impact element 17. The flow that is created during opening becomes effective only in the upper region of the linear stroke, but this is compensated for by the magnetic force that has already been completely built up.

When the current exciting magnet coil 8 is switched off, armature 12 is accelerated in the spray-discharge direction by the coaction of various forces. In the embodiment of fuel injection valve 1 according to the present invention, the spring force of return spring 10 (which is weakly dimensioned) makes a contribution in this context to the total force, as does the momentum of the fuel flowing through armature 12, which is transferred to impingement surface 20 of impact element 17 and thus to valve needle 3. A slight back pressure which forms on the inflow side of armature 12 also contributes to rapid closing of fuel injection valve 1.

The path of the fuel through fuel conduit 16 in armature 12 is indicated schematically in FIG. 2 by arrows 18. When the fuel flows through an inner recess 14 of core 11, it possesses a momentum $p_1=m*v_1$, where m is the mass and $v_1$ the flow velocity of the fuel in central recess 14 of fuel injection valve 1. The cross section $A_2$ of bore 16 in armature 12 is very much smaller than the cross section $A_1$ of central recess 14, resulting in a considerable increase in the velocity of the fuel and an elevation in momentum, as defined by the continuity equations $A_1*v_1=A_2*v_2$ and $A_1*p_1=A_2*p_2$. The momentum $p_2$ of the fuel as it emerges from fuel conduit 16 in armature 12 is thus considerably greater than the momentum $p_1$ of the fuel in recess 14.

If impact element 17 is arranged on valve needle 3 at a sufficiently short distance d from a spray-discharge-side armature end face 19, the momentum $p_2$ of the fuel can be used to accelerate the component comprising armature 12, valve needle 3, and impact element 17 in the closing direction. The total momentum transferred is ideally $2*p_2$, since a momentum $p_2$ is respectively transferred when the stream of fuel strikes impingement surface 20 of impact element 17, and when the stream of fuel is reflected. The distance d between armature end face 19 and impact element 17 must therefore be selected on the one hand so that the loss of fuel momentum due to turbulence and stream spreading is minimized, but on the other hand so that after striking impact element 17, the stream of fuel is not reflected in such a way that it would again strike armature end face 19, since as a result the momentum transfer in the closing direction would be overlain by a second momentum transfer in the opening direction. The intended effect of the momentum transfer would thereby be considerably attenuated.

The flow profile of the fuel is depicted schematically in FIG. 2 by directional arrows 18. The stream of fuel can be further directed in the desired direction by way of a slight conical obliquity of impingement surface 20 of impact element 17 in the radial direction.

The present invention is not limited to the exemplary embodiment depicted, and can also be carried out in the context of a plurality of other designs for fuel injection valves 1. Fuel conduit 16 can also extend at least partially through valve needle 3. In the case of an outward-opening fuel injection valve 1, a reversal of the flow direction of fuel conduit 16 is necessary.

What is claimed is:

1. A fuel injection valve comprising:

a magnet coil;

a return spring;

an armature acted upon in a closing direction by the return spring;

a valve closure element;

a valve needle, in nonpositive engagement with the armature, for actuation of the valve closure element, at least one fuel conduit through which fuel flows being situated in at least one of the armature and the valve needle;

a valve seating surface, the valve closure element and the valve seating surface together forming a sealing fit; and an impact element mounted on the valve needle downstream from the fuel conduit, the fuel flowing through the fuel conduit striking the impact element.

2. The fuel injection valve according to claim 1, wherein the valve is for a fuel injection system of an internal combustion engine.

3. The fuel injection valve according to claim 1, wherein the impact element is situated downstream from a spray-discharge end of the armature.

4. The fuel injection valve according to claim 1, wherein the fuel conduit is dimensioned such that the fuel flowing through the fuel conduit is accelerated.

5. The fuel injection valve according to claim 1, wherein the impact element is joined to the valve needle such that the fuel emerging from the fuel conduit strikes the impact element vertically.

6. The fuel injection valve according to claim 5, wherein momentum transferred by way of the fuel onto the impact element accelerates the valve needle in the closing direction.

7. The fuel injection valve according to claim 1, wherein the impact element has a plate-shaped configuration.

8. The fuel injection valve according to claim 1, wherein the impact element is configured integrally with the valve needle.

* * * * *